US005955127A

United States Patent [19]

Glaser

[11] Patent Number: 5,955,127

[45] Date of Patent: Sep. 21, 1999

[54] CLOSURE FOR VACUUM-SEALED CONTAINERS WITH RESEALABLE PRESSURE RELEASE

[76] Inventor: Lawrence F. Glaser, 10705 Averett Dr., Fairfax Station, Va. 22039

[21] Appl. No.: 09/003,131

[22] Filed: Jan. 6, 1998

[51] Int. Cl.[6] ..... B65D 85/00; B65D 51/16; B65D 17/32

[52] U.S. Cl. ..... 426/106; 426/123; 215/262; 220/271

[58] Field of Search ..... 426/106, 123; 215/270, 262, 248, 249; 220/271

[56] References Cited

U.S. PATENT DOCUMENTS

| | | | |
|---|---|---|---|
| 3,850,330 | 11/1974 | Koontz et al. . | |
| 4,960,206 | 10/1990 | Johannes . | |
| 5,460,285 | 10/1995 | Harding, Sr. | 220/203.1 |
| 5,584,409 | 12/1996 | Chemberlen | 220/89.1 |
| 5,692,632 | 12/1997 | Hsieh et al. | 220/212 |
| 5,713,481 | 2/1998 | Jordan | 220/271 |
| 5,779,082 | 7/1998 | Miramon . | |

*Primary Examiner*—Nina Bhat

*Attorney, Agent, or Firm*—Sixbey, Friedman, Leedom & Ferguson; David S Safran

[57] ABSTRACT

A food container, of the type having a quantity of food vacuum-packed within a body of the container with a closure affixed on an open end of the body of the container, is provided with a low cost improvement for facilitating removal of the closure from the body of the container in the form of a vent opening extending through a wall of the closure overlying the open end of the container and a flexible film strip, a portion of which is sealed to the wall around an area overlying the vent opening. A portion of the film strip which overlies the vent opening is designed to be released from closure wall for equalizing the pressure within the container with that external thereto by pulling up on an unsecured end portion of the film strip. Furthermore, after releasing of the vacuum in the container, the film strip is able to be re-adhered over the vent opening. Additionally, the vent opening and the film strip are located within a locally recessed portion of closure wall so as to prevent inadvertent dislodging of the film strip or damage to it.

10 Claims, 1 Drawing Sheet

FIG. 1
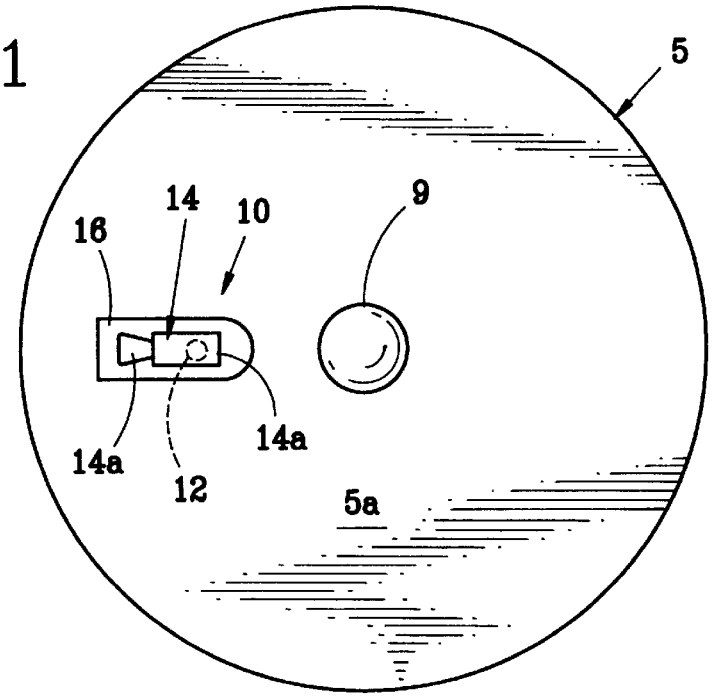
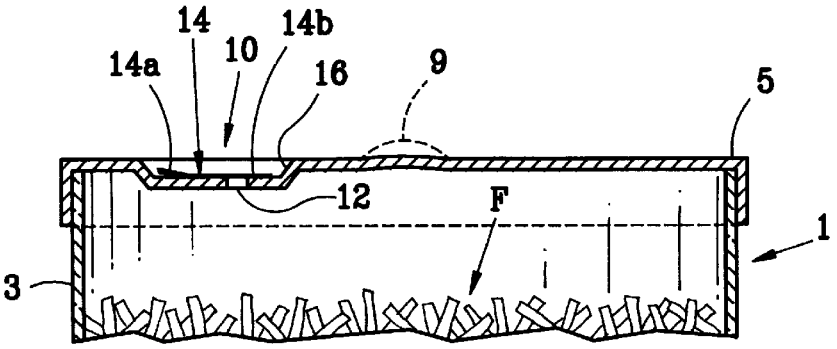
FIG. 2
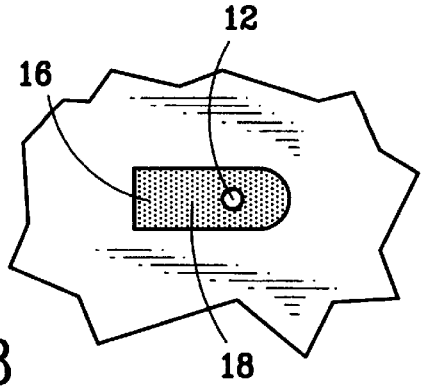
FIG. 3

CLOSURE FOR VACUUM-SEALED CONTAINERS WITH RESEALABLE PRESSURE RELEASE

BACKGROUND OF THE INVENTION

1. Field of the Invention

The present invention relates to lids, caps other closures for jars, bottles and containers of various types as are used for storing foods under subatmospheric pressure, such as, for example, those having screw or twist off closures.

2. Description of Related Art

Anyone who regularly uses food items stored in jars, bottles or other containers which have been vacuum-sealed has, at one time or another, experienced the frustration of trying to remove the lid, cap or other closure by twisting or prying it against the holding force of the subatmospheric pressure under which the food has been packed. The marketplace is full of implements designed to enable a consumer to obtain greater leverage or obtain a more secure grip on the closure to facilitate its removal. Likewise, numerous home remedies have been devised of the years, such as running the closure under hot water, banging it on a counter top, and the like. Nonetheless, none of these techniques provide a simple, fool proof, quick and easy solution to removal of a closure that acts like it has been welded in place, simply due to effect of the very low pressure that exists within the container.

Of course, containers are well known that have reclosable openings which serve for pressure equalization. For example, containers with pour spouts for dispensing liquid contents of the container, such as gasoline cans, have an opening intended to be located at a high point of the container during pour for the purpose of allowing air to be drawn into the container as its contents are poured out to prevent creation of a vacuum in the container which would affect dispensing of the liquid through the spout. Such an opening usually has a snap-on cap which serves to prevent evaporation of the gasoline when the container is not in use and is designed to pop-off if, due to high temperatures in the storage location, pressure within the container reaches a dangerously high level because of the volatile nature of the contents. However, such pressure equalization openings are not directly applicable to vacuum-packed, food storage containers for various reasons related to the manner in which food packages are stored and displayed, government safety regulations, consumer confidence issues and the like.

On the other hand, attempts have been made to apply such a pressure equalization concept to vacuum-packed food storage containers, for example, by the use of a modified form of the type of pop-top container pull tab to open a vent hole punched in the top wall of the container. Such vented closure caps are described in U.S. Pat. No. 3,850,330 and a form of such a closure cap in which a tamper indicator has been incorporated can be found in U.S. Pat. No. 4,960,206. However, these types of complex vent arrangements have never found commercial acceptance, presumably because of the fact that they are costly to implement, require significant changes to the container and the manner in which it is produced and packaged, are not universally applicable. Still further, these arrangements neither address the problem of spoilage of the unused product if the container cannot be fully reclosed, nor do they provide the consumer with the immediate and familiar tamper indicating button which is currently a standard feature on virtually all vacuum-sealed jars.

Thus, a need exists for a closure for vacuum-packed food containers which will provide a means for relieving the vacuum within the container so as to provide a simple, fool proof, quick and easy solution to the problem of removing the container closure, yet will also address all storage, display, safety and consumer confidence issues.

SUMMARY OF THE INVENTION

In keeping with the foregoing, it is a primary object of the present invention to provide a closure with a means for relieving the vacuum within a vacuum-packed container that will provide a simple, fool proof, quick and easy means for removing it from the container and that can be incorporated into all categories of consumer and manufacturer preferred vacuum-packed food containers currently in use with a minimum disruption to the manufacturing and packaging processes.

It is a further object to provide a closure, that will also address all storage, display, safety and consumer confidence issues.

It is yet another object of the invention to enable the foregoing objects to be achieved at a low enough cost as to enable use of the invention without perceptible product price increases to the consumer being required.

In keeping with the preceding object, it is a particular object of the present invention to provide a closure with a vacuum vent which requires only a single inexpensive strip of material to implement on an otherwise conventional container closure.

These and other objects of the invention are achieved by providing a closure for vacuum-packed food containers which has, in addition to the conventional pop-up button tamper indicator, a pull-up strip which can be used to expose a vent opening in the closure for purposes of releasing the vacuum within the container to allow for easy release of the cover. Furthermore, by utilizing a re-adhereable bonding agent on the strip, when the container is reclosed, the strip can be re-affixed to provide for proper sealing of any unused contents of the container.

At the same time, consumers need not be concerned about the vent serving as an access point for tampering with the quality of the contained product, such as by the introduction of poisons or other contaminants. This is because the pull-up strip is designed such that it cannot be raised or pierced without releasing the vacuum which serves to hold down the tamper indicator button.

In order to enable the containers to be stored and/or displayed in the usual stacked manners which are customary in the food industry without interference from the pull-up strip, and without the fear of the strip being inadvertently dislodged, it is advantageous that the cover is provided with a recessed area within which the vent opening and the pull-up strip are located.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 1 is a plan view of a container with a closure in accordance with the present invention;

FIG. 2 is a cross-sectional view of the top portion of the container of FIG. 1; and FIG. 3 is a plan view of the portion of the closure shown in FIG. 1 in the area of the vent with the seal removed.

DETAILED DESCRIPTION OF THE PREFERRED EMBODIMENT

FIG. 2 shows a container 1 having a conventional jar type container body 3 made of glass; however, this body can be made of any material or construction that is in use in the food packaging art. A closure in the form of a conventional cap or lid 5 is affixed on the body 3 of the container 1, and it is held thereon closing the open end of the body at least in part by subatmospheric pressure existing within the container due to vacuum packing of the food contents F therein, such as by filling and sealing the container with the food F in a heated condition so that a vacuum is created when it cools. The lid 5 may also be held in place by a thread, twist lock or other fastening means known in the art. Still further, as also known, the top wall 5*a* of the closure 5 has a centrally positioned area in the form of a button 9 which is raised in an unstressed condition thereof (represented by dotted line in FIG. 2) and which is resiliently held in a prestressed position deflected in toward the container by the subatmospheric pressure created in the container after it has been packed, the button 9 returning to its unstressed condition upon releasing of the vacuum in the container to provide a vision indication to the consumer that the sealing of the contents has been broken, so that the contents may no longer be fresh or may have been tampered with. Since the specifics of creating such a button indicator in a metal lid or cap type closure is, itself, well known and forms no part of the present invention, further description thereof is unnecessary and will be dispensed with.

As can be appreciated, to the extent described so far, container 1 is indistinguishable from any conventional vacuum-packed food container. The improvement of the present invention, in the form of a pressure release arrangement 10 for facilitating the removal of the closure lid 5 from the body 3 of the container 1, will now be described. This arrangement 10 comprises a vent opening 12 extending through the top wall 5*a* of the closure lid 5 and a flexible film strip 14, a main portion 14*a* of the strip 14 is releasably sealed to the top wall 5*a* in an area around vent opening 12, so that the film strip 14 overlies the vent opening 12, closing it. An end portion 14*b* of the film strip 14 is left unsecured so that it may be manually grasped and pulled up for enabling the portion of the film strip 14 overlying vent opening 12 to be released from the wall 5 by allowing air to enter the container, to equalize the pressure within the container 1 with that external thereto.

Preferably, an adhesive is used to hold the main portion 14*a* to the wall 5*a*, and particularly one of the known nonpermanent types which will retain a tacky adherent nature when the portion 14*a* is pulled up off of it, in order to enable resealing of portion 14*a* of the film strip 14 once the vacuum within the container 1 has been released. Of course, such is not the exclusive means for affixing the film strip 14; for example, the adhesive may applied to the film strip instead of the top wall and/or the film strip 14 can be provided with fracture lines or the like in one or more areas away from opening 12 and secured by a permanent adhesive in those areas, so that parts of the film strip 14 will tear or pull out and remain affixed to the top wall. In this way, despite resealing of the film strip 14, a visual indication that the vacuum has been broken and the hole exposed can be provided in addition to or instead of that provided by button 9.

Still further, preferably the vent opening 12 and at least the main portion 14*a* of film strip 14 are located within a locally recessed portion 16 of wall 5*a* of the closure 5. By so locating the vent opening 12 and the main portion 14*a* of film strip 14, special handling care is not required and containers equipped with the vent arrangement 10 can be stored and/or displayed in the usual stacked manners which are customary in the food industry without interference from the pull-up strip, and without the fear of the strip being inadvertently damaged or accidentally pulled off.

In order to prevent rupturing of the strip 14 due to vacuum exerted thereon through the vent opening 12, preferably the opening 12 is kept relatively small. For example, an opening 12 of 1–2 mm diameter or less is recommended. Additionally, for the same reason, and to insure that the strip has sufficient strength to be pulled off of the adhesive without tearing (except as may deliberately be planned for via fracture lines or the like as indicated above), the film strip 14 is preferably made at least in part of a plastic film, metal foil or a laminate having multiple layers or one, the other or both.

While a single embodiment in accordance with the present invention has been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

I claim:

1. In a vacuum-packed food container having a body with an open end, a quantity of food disposed within the body, and a closure affixed on the body of the container and held closing the open end thereof at least in part by subatmospheric pressure existing within the container, the improvement for facilitating removal of the closure from the body of the container comprising a vent opening extending through a wall of the closure overlying the open end of the container and a flexible film strip, a portion of which is sealed to said wall around an area overlying said vent opening in a manner enabling a portion of said film strip overlying said vent opening to be released from said wall for equalizing the pressure within the container with that external thereto by pulling up on an unsecured end portion of the film strip and in a manner enabling resealing of said portion of the film strip thereafter; wherein said vent opening and said film strip are located within a locally recessed portion of said wall of the closure.

2. A vacuum-packed food container according to claim 1, wherein said wall of the closure has a centrally positioned area in the form of a raised button in an unstressed condition thereof which is resiliently held in a prestressed position deflected into the container by said subatmospheric pressure, said raised area returning to its unstressed condition upon releasing of said portion of the film strip.

3. A vacuum-packed food container according to claim 2, wherein said film strip is formed at least in part of a plastic film.

4. A vacuum-packed food container according to claim 2, wherein said film strip is formed at least in part of a metal foil.

5. A vacuum-packed food container according to claim 2, wherein said vent opening has a diameter of less than about 2 mm.

6. A vacuum-packed food container according to claim 2, wherein said closure is formed of metal and said vent opening, said recess and said raised button are stamped therein.

7. A vacuum-packed food container according to claim 1, wherein said film strip is formed at least in part of a plastic film.

8. A vacuum-packed food container according to claim 1, wherein said film strip is formed at least in part of a metal foil.

9. A vacuum-packed food container according to claim 1, wherein said vent opening has a diameter of less than about 2 mm.

10. A vacuum-packed food container according to claim 1, wherein said closure is formed of metal and said vent opening, recess and raised button are stamped therein.

* * * * *